US008974042B2

(12) United States Patent
Kobayashi

(10) Patent No.: US 8,974,042 B2
(45) Date of Patent: Mar. 10, 2015

(54) LIQUID SUPPLY FLOW PATH DEVICE AND LIQUID EJECTING APPARATUS USING THE SAME

(71) Applicant: Seiko Epson Corporation, Tokyo (JP)

(72) Inventor: Atsushi Kobayashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/668,390

(22) Filed: Nov. 5, 2012

(65) Prior Publication Data

US 2013/0057620 A1 Mar. 7, 2013

Related U.S. Application Data

(63) Continuation of application No. 12/933,697, filed as application No. PCT/JP2009/001323 on Mar. 25, 2009, now abandoned.

(30) Foreign Application Priority Data

Mar. 25, 2008 (JP) ..... 2008-078159

(51) Int. Cl.
*B41J 2/175* (2006.01)
*B41J 2/17* (2006.01)

(52) U.S. Cl.
CPC ..... *B41J 2/175* (2013.01); *B41J 2/17503* (2013.01); *B41J 2/17523* (2013.01)
USPC ..... 347/85; 347/84

(58) Field of Classification Search
USPC ..... 347/84, 85, 86
See application file for complete search history.

(56) References Cited

U.S. PATENT DOCUMENTS

| | | | | |
|---|---|---|---|---|
| 5,963,236 | A | 10/1999 | Miyashita et al. | |
| 6,481,838 | B1 | 11/2002 | Brugue et al. | |
| 6,913,342 | B2 * | 7/2005 | Dewey et al. | 347/49 |
| 7,540,587 | B2 | 6/2009 | Kobayashi et al. | |
| 2003/0218660 | A1 | 11/2003 | Matsumoto et al. | |
| 2004/0125182 | A1 | 7/2004 | Akermalm | |
| 2005/0088493 | A1 | 4/2005 | Koga | |
| 2006/0001715 | A1 * | 1/2006 | Umeda et al. | 347/86 |
| 2006/0017755 | A1 | 1/2006 | Shinada | |
| 2006/0187504 | A1 | 8/2006 | Kawashima | |

(Continued)

FOREIGN PATENT DOCUMENTS

| | | |
|---|---|---|
| CN | 101052528 A | 10/2007 |
| JP | 08-281967 | 10/1996 |

(Continued)

OTHER PUBLICATIONS

"Altering a printer on mainland China (second part)", http://aizax.fc2-rentalserver.com/00internet/060414.html, anonymous writer, Samurai Cyuuzaiin (Japanese expatriate), Apr. 14, 2006.

(Continued)

*Primary Examiner* — Jannelle M Lebron

(57) ABSTRACT

A recording apparatus comprises a case and an ink nozzle in the interior of the case. An opening and closing member is movably affixed to an upper side of the case. The opening and closing member is configured to open and close. An external tank is located exterior to the case. A tube provides a liquid from the external tank to the ink nozzle. A portion of the tube extends into the case through a gap between the case and the opening and closing member in the closed position.

7 Claims, 7 Drawing Sheets

(56) References Cited

U.S. PATENT DOCUMENTS

| | | | |
|---|---|---|---|
| 2006/0203045 | A1 | 9/2006 | Kobayashi et al. |
| 2007/0097167 | A1 | 5/2007 | Ishikawa |
| 2008/0211884 | A1 | 9/2008 | Saito et al. |
| 2009/0256893 | A1 | 10/2009 | Kobayashi et al. |
| 2010/0134574 | A1 | 6/2010 | Kobayashi et al. |
| 2011/0018947 | A1 | 1/2011 | Kobayashi |
| 2011/0279587 | A1 | 11/2011 | Kobayashi et al. |
| 2014/0036012 | A1 | 2/2014 | Kobayashi et al. |

FOREIGN PATENT DOCUMENTS

| | | |
|---|---|---|
| JP | 09-323430 | 12/1997 |
| JP | 10-226084 | 8/1998 |
| JP | 2000-211162 | 8/2000 |
| JP | 2002-127450 | 5/2002 |
| JP | 2002-267052 | 9/2002 |
| JP | 2003-320680 | 11/2003 |
| JP | 2004-262092 | 9/2004 |
| JP | 2005-040972 | 2/2005 |
| JP | 2005-125533 | 5/2005 |
| JP | 2005-254684 | 9/2005 |
| JP | 2005-305878 | 11/2005 |
| JP | 2006-035484 | 2/2006 |
| JP | 2006-231654 | 9/2006 |
| JP | 2006-305940 | 11/2006 |
| JP | 2006-349040 | 12/2006 |
| JP | 2007-076271 | 3/2007 |
| JP | 2007-144776 | 6/2007 |
| JP | 2007-160795 | 6/2007 |
| JP | 2007-245451 | 9/2007 |
| WO | 2006/082836 A1 | 8/2006 |
| WO | 2009/119084 A1 | 10/2009 |

OTHER PUBLICATIONS

NPL—<URL:http://inkmiyax.blog81.fe2.com/blog-entry-80.html> (English) Almost completed. Continuous ink-supplying apparatus for MP600; A Surefire method for reducing the ink cost of your printer, Oct. 24, 2007.

NPL—<URL:http://inkmiyax.blog81.fe2.com/blog-entry-76.html> (English) It is easy even with an A3 printer: A surefire method for reducing the ink cost of a printer S6300 (continuous ink-supplying), May 29, 2007.

PIXUS MP600 Model Specifications, Canon Inc, URL:http://cweb.canon.jp/pls/webcc/WC_SHOW_CONTENTS.EdtDsp?i_cd_pr_catg=011&i_tx_contents_dir=/e-support/faq/answer/inkjetmfp/&i_tx_contents_file=32547-1.html&i_fl_edit=1&i_tx_search_pr_name=&i_cl_form=03&i_cd_qasearch=Q000032547&i_cd_transition=2 (pp. 1-12).

* cited by examiner (A)

(B)

LIQUID SUPPLY FLOW PATH DEVICE AND LIQUID EJECTING APPARATUS USING THE SAME

CROSS-REFERENCE TO RELATED APPLICATIONS

This application is a continuation of, and claims priority under 35 U.S.C. §120 on, application Ser. No. 12/933,697, filed Sep. 21, 2010, which is a 371 of PCT/JP2009/001323 filed Mar. 25, 2009, which claims priority under 35 U.S.C. §119 on Japanese Patent Application No. 2008-078159, filed on Mar. 25, 2008. Each of the above-identified priority applications is hereby expressly incorporated by reference herein in its entirety.

BACKGROUND

1. Technical Field

The present invention relates to a liquid supply flow path device that connects a liquid ejecting apparatus body such as a printer to an external tank, and a liquid ejecting apparatus using the same.

2. Background Art

In the existing art, an ink jet type printer (hereinafter, referred to as "printer") is widely known as a liquid ejecting apparatus that ejects a liquid to a target. The printer has a recording head on a carriage that reciprocates, and printing is performed on a recording medium as a target by ejecting an ink (liquid) supplied from an ink cartridge (liquid receiver) to the recording head, from a nozzle formed in the recording head. As such printers, in the existing art, for example, there are known: printers of a type in which an ink cartridge is mounted on a carriage (so-called on-carriage type) as described in Patent Document 1; and printers of a type in which an ink cartridge is mounted at a fixing position on the printer which is different from a carriage (so called off-carriage type) as described in Patent Document 2.

Patent Document 1: JP-A-2004-262092

Patent Document 2: JP-A-2003-320680

DISCLOSURE OF INVENTION

Problems to be Solved by the Invention

Here, particularly in a printer of on-carriage type, the ink capacity of an ink cartridge is small because of a mounting space on a carriage. Thus, when a relatively large amount of printing is to be performed, it is necessary to frequently replace the ink cartridge. Therefore, when such a large amount of printing is performed, in addition to requiring a hand for replacement of the ink cartridge, there is a problem that the running cost increases. Even in off-carriage type, when a large amount of printing is to be performed, it is necessary to replace an ink cartridge, although less frequently than in on-carriage type. Particularly, in home-use ones among off-carriage type, the capacity of an ink cartridge is small, and hence the frequency of replacement becomes high.

For that reason, in the existing art, an external tank having a large capacity may be connected to a printer to modify the printer. When such a modification is made, in order to supply an ink from the external tank to the inside of the printer, an ink supply tube is led from the outside of the printer to the inside thereof.

However, the printer is covered with a casing cover for the purposes of sound insulation and design, and the ink supply tube only has to be forced to pass through a gap in the casing cover. When the ink supply tube is forcefully bent or the diameter of the ink supply tube is larger than the gap, the ink supply tube is folded or flattened, so that the ink supply tube is blocked and an ink cannot be supplied.

Further, in the case where the ink supply tube is passed through the gap in the casing cover that is openable and closable, when opening or closing the cover, a situation may occur where the ink supply tube is pinched and flattened so that the ink cannot be supplied from the external tank.

If the reason why the ink cannot be supplied is noticed quickly, correction can be made. However, if printing is continued without notice, blank ejection occurs at the ink nozzle, causing a breakdown of the printer body. After all, the printer manufacturer will deal with the breakdown of the printer and hence cannot leave such a situation as it is.

From such circumstances, embodiments of the invention arise.

SUMMARY

A recording apparatus according to embodiments of the invention comprises a case in the interior of which is an ink nozzle; an opening and closing member movably affixed to an upper side of the case, the opening and closing member being configured to open and close; an external tank located exterior to the case; and a tube that provides a liquid from the external tank to the ink nozzle. A portion of the tube extends into the case through a gap between the case and the opening and closing member in the closed position.

The gap may be formed as a cutout.

The opening and closing member may comprise a scanner.

Other aspects of the invention together with a fuller understanding of the invention will become apparent and appreciated by referring to the following description and claims taken in conjunction with the accompanying drawings.

REFERENCE NUMERALS

Figure 1:
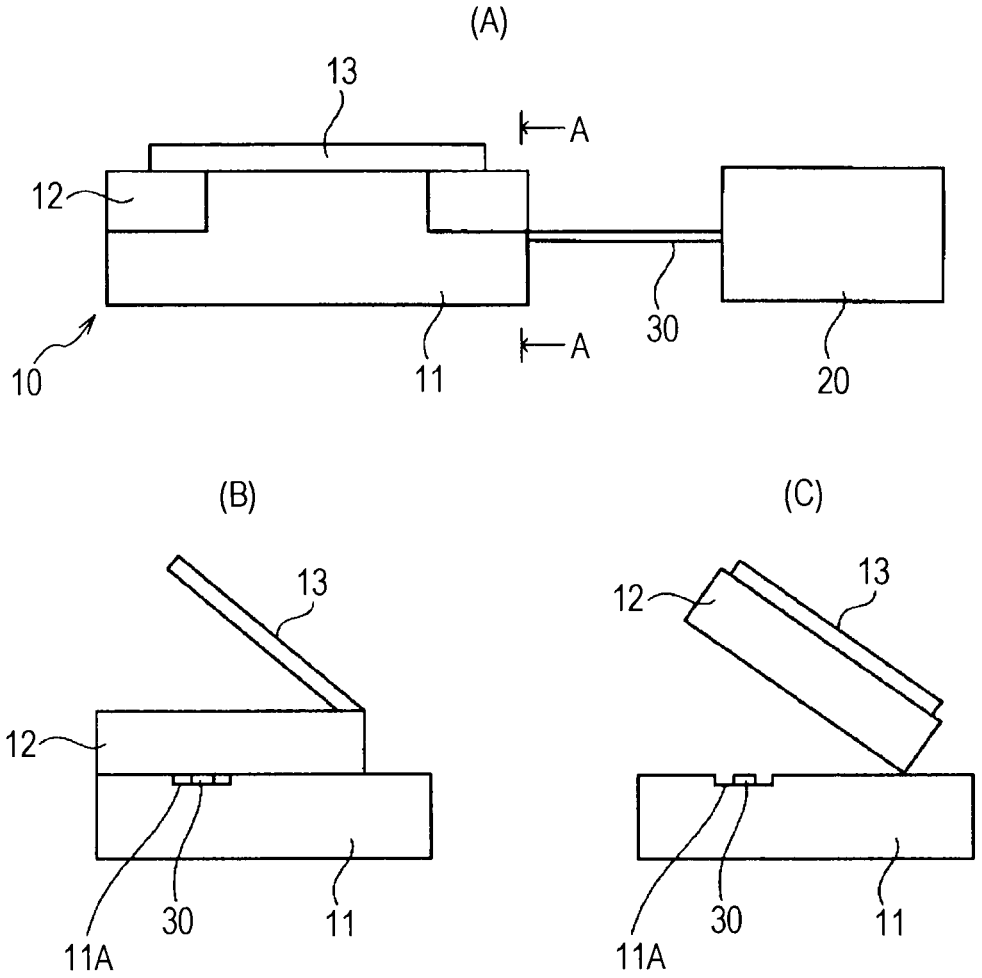
FIG. 1(A) is an overall view of a liquid ejecting apparatus according to an embodiment of the invention.
FIG. 1(B) is a side view showing a state where a scanner cover of a printer body shown in FIG. 1(A) is opened.
FIG. 1(C) is a side view showing a state where an upper casing cover of the printer body shown in FIG. 1(A) is opened.

10 liquid ejecting apparatus body
11 lower casing cover (outer wall cover)
11A cutout portion
11B inner wall cover
11C step portion
12 upper casing cover
20 external tank
30, 30A to 30D liquid supply flow path device
31 first flow path
32 second flow path
33 third flow path
34 upstream flow path
35 downstream flow path
40 flow path defining member
41 first plate-like member
41A through hole
42 second plate-like member
42A recess portion
43 third plate-like member
43A through hole
44 upstream member
44A recess portion
45 downstream member
45A recess portion
50 thin plate-like member
60 first thin plate-like member
61 second thin plate-like member
62, 63 partition member
70A, 70B metal pipe
80 flexible tube
82, 84 holding case
90A, 90B ink reservoir
100A, 100B liquid delivery member
110 inner flow path

DETAILED DESCRIPTION

Hereinafter, preferred embodiments of the invention will be described in detail. Note that the embodiments described below do not unduly limit the contents of the invention defined in the claims, and not all structures described in the embodiments are necessarily essential for means of the invention for solving the problems.

(Outline of Liquid Ejecting Apparatus)

FIGS. 1(A) to 1(C) show an ink jet printer that is one embodiment of a liquid ejecting apparatus according to the invention. FIG. 1(A) is a front view showing an overall configuration of the ink jet printer. The printer includes: a printer body 10; an external tank 20 that is located outside the printer body 10; and an ink supply flow path device (liquid supply flow path device) 30 that supplies an ink, which is a liquid, from the external tank 20 to the inside of the printer body 10. The external tank 20 is capable of sending the ink therein under pressure by water head difference or by external application of pressure. Alternatively, the ink within the external tank 20 may be sucked by a mechanism within the printer body 10.

The printer body 10 includes, in its inside surrounded by a lower casing cover (first casing cover) 11 and an upper casing cover (second casing cover) 12, a platen that supports paper, a carriage that reciprocates along a guide shaft parallel to the platen, a recording head (liquid ejecting head) that is mounted to the carriage, an ink cartridge that supplies an ink to the recording head, and the like. A scanner cover 13 is located on the upper casing cover 12.

FIG. 1(B) is a side view showing a state where the scanner cover 13 is opened. While the scanner cover 13 is opened, a document is placed on a document base. When the scanner cover 13 is closed and a start button is pressed, scanning of the document is started, and printing is performed at the printer body 10. The printer body 10 is a complex machine, and printing at the printer body 10 is not limited to a document read by a scanner and, for example, printing of information transmitted from a personal computer is also possible.

Further, FIG. 1(C) shows a state where the upper casing cover 12 is opened during maintenance. The ink supply flow path device 30 is introduced from the outside of the printer body 10 to the inside thereof through a gap between the lower casing cover 11 and the upper casing cover 12. In the embodiment, as shown in FIGS. 1(B) and 1(C), a cutout portion 11A is formed in a side of the lower casing cover 11 and an upper edge thereof is partially removed. The cutout portion 11A is provided originally for securing a gap with the upper casing cover 12 such that a finger can engage the upper casing cover 12 when opening or closing the upper casing cover 12.

In the embodiment, the ink supply flow path device 30 is introduced from the outside of the printer body 10 to the inside thereof through the largest gap between the lower and upper casing covers 11 and 12, which is secured at the cutout portion 11A. In this manner, by utilizing the gap previously formed in the printer body 10, the ink supply flow path device 30 can be mounted to the printer body 10 without impairing the operability, the performance, and the appearance of the printer body 10.

(Liquid Supply Flow Path Device)

Figure 2:
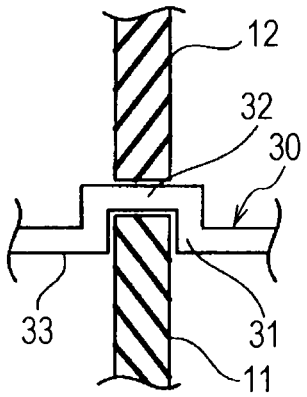
FIG. 2 is a schematic cross-sectional view showing one mounting form of a liquid supply flow path device located between lower and upper casing covers.
Figure 3:
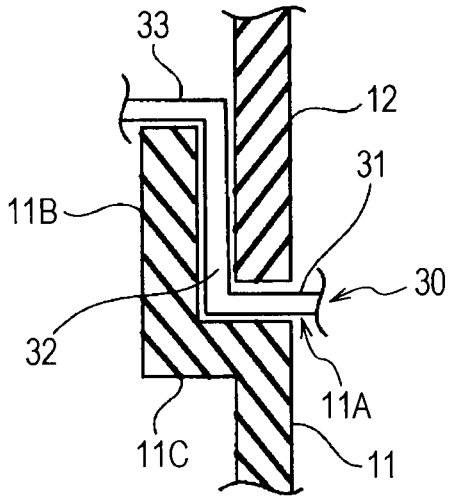
FIG. 3 is a schematic cross-sectional view showing another mounting form of the liquid supply flow path device located between the lower and upper casing covers.

Next, the ink supply flow path device (liquid supply flow path device) 30 will be described. FIGS. 2 and 3 show examples of an A-A cross section of FIG. 1(A). FIG. 2 shows an example in which the ink supply flow path device 30 is located, for example, along the lower casing cover 11 through a gap between edge surfaces at which an upper edge of the lower casing cover 11 faces a lower edge of the upper casing cover 12. In FIG. 3, an inner wall cover 11B that faces an inner side of the upper casing cover 12, and a step portion 11C that connects inner and outer wall covers, are provided at the upper edge of the lower casing cover (outer wall cover) 11. In this case as well, the ink supply flow path device 30 is located, for example, along the lower casing cover (outer wall cover) 11, the step portion 11C, and the inner wall cover 11B, through a gap between: the lower casing cover (outer wall cover) 11, the step portion 11C, and the inner wall cover 11B; and the upper casing cover 12.

In the case of FIG. 2, for example, a channel-shaped (substantially U-shaped) flow path is essential for the ink supply flow path device 30 to be held by being located along the lower casing cover 11 and to extend beyond the lower casing cover 11. On the other hand, in the case of FIG. 3, a crank-shaped flow path is essential for the ink supply flow path device 30 to extend beyond the lower casing cover (outer wall cover) 11, the step portion 11C, and the inner wall cover 11B along the lower casing cover (outer wall cover) 11, the step portion 11C, and the inner wall cover 11B.

In either cases of FIGS. 2 and 3, the ink supply flow path device 30 defines at least one flow path (a plurality of flow paths is possible) including: a first flow path 31; a second flow path 32 that communicates with one end of the first flow path 31 and extends along a direction intersecting the first flow path 31, for example, perpendicular to the first flow path 31; and a third flow path 33 that communicates with another end of the second flow path 32 and extends in a direction intersecting the second flow path 32, for example, perpendicular to the second flow path 32. In either cases of FIGS. 2 and 3, the ink supply flow path device 30 having such a shape is located along the lower casing cover 11 or the upper casing cover 12 through the gap between the lower casing cover 11 and the upper casing cover 12, thereby supplying the ink from the outside of the printer body 10 to the inside thereof.

Particularly, when the second flow path 32 is located substantially horizontally, bubbles having a low specific gravity can be discharged to a space above the ink in the second flow path 32 to implement removal of the bubbles, and only the ink can be supplied due to the bubble trapping.

Preferably, the ink supply flow path device 30 includes a flow path formation member that has shape retention for a bent flow path that is bent in a channel shape or in a crank shape with a flow path (the second flow path 32 in the example of FIG. 2) located in the gap between the lower casing cover 11 and the upper casing cover 12 being a flat flow path in which a maximum flow path height is smaller than a flow path width. The flat flow path having a small flow path height is needed in order to be located in the gap between the lower and upper casing covers 11 and 12 shown in FIGS. 2 and 3, and the flow path width is made larger than the flow path height in order to increase the cross-sectional area of the flow path. The shape retention is a character to maintain a shape. Due to the shape retention, even when the upper casing cover 12 is opened or closed as in FIG. 1(C), the flow path formation member can be prevented from being pinched between the lower and upper casing covers 11 and 12. Note that it is only necessary for the channel-shaped flow path or crank-shaped flow path shown in FIG. 2 or 3 to at least have these characteristics. A flow path on the upstream side of the first flow path 31 (a flow path outside the printer body 10) and a flow path on the downstream side of the third flow path 33 (a flow path inside the printer body 10) are not located between the lower and upper casing covers 11 and 12, and thus, besides the shape of the bent flat flow path described above, various shapes and characters can be used therefor.

Note that, in the case where contamination of bubbles and the like in a liquid to be supplied should be avoided as in the ink, the flow path formation member for forming the ink supply flow path device 30 preferably has a low permeability coefficient for oxygen and hydrogen. For the oxygen·hydrogen permeability coefficient, although depending on the shape of the flow path, in normal temperature environment, an oxygen permeability coefficient is 200 [cc·mm/$m^2$·day·atm] or less and more desirably 100 or less, and a water vapor permeability coefficient is 0.2 [g·mm/$m^2$·day] or less and more desirably 0.1 or less.

(First Embodiment of Ink Supply Flow Path Device)

Figure 4:
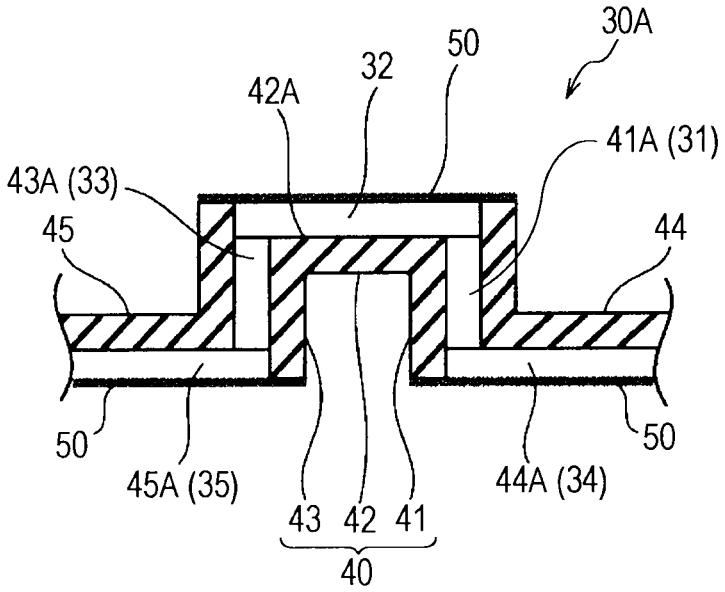
FIG. 4 is a schematic cross-sectional view of a liquid supply flow path device according to a first embodiment.
Figure 5:
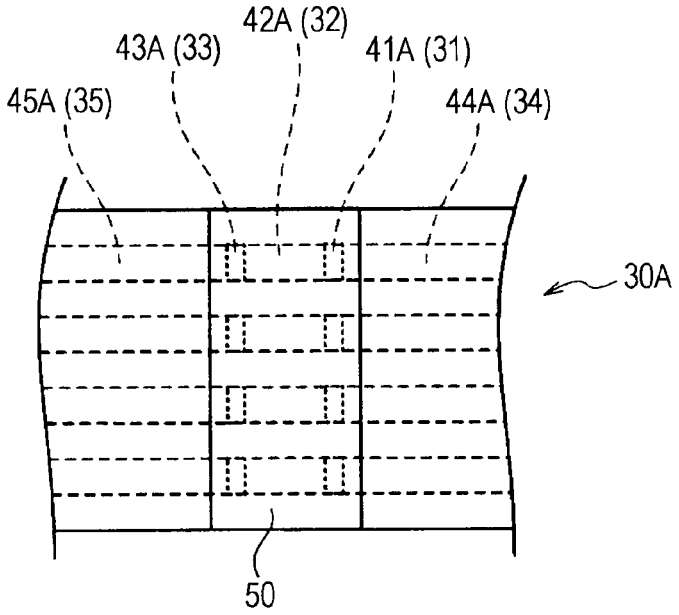
FIG. 5 is a plan view of the liquid supply flow path device according to the first embodiment.
Figure 6:
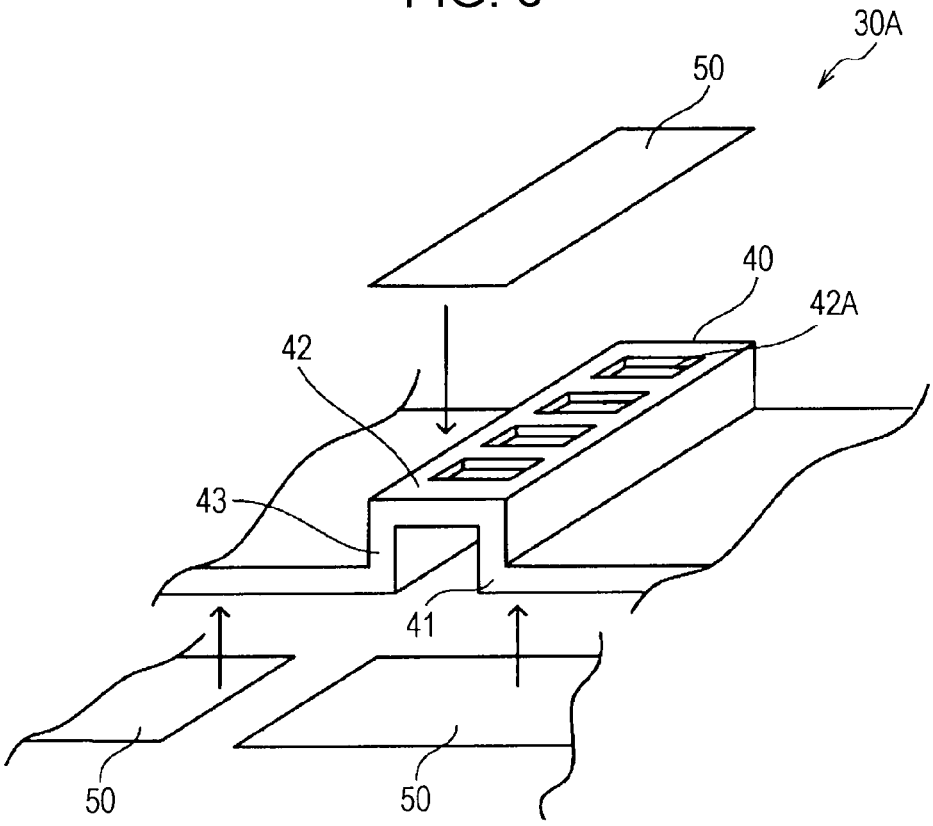
FIG. 6 is an exploded perspective view of the liquid supply flow path device according to the first embodiment.

Hereinafter, specific examples of the ink supply flow path device 30 having the channel-shaped flow path shown in FIG. 2 will be described. FIGS. 4 to 6 show an ink supply flow path device 30A according to a first embodiment. As shown in FIGS. 4 and 6, the ink supply flow path device 30A includes, as a flow path formation member, a flow path defining member 40 and thin plate-like members 50. The flow path defining member 40 is formed from a material having shape retention, such as a resin, a metal, an elastomer, a rubber, or the like. The thin plate-like members 50 can be formed from a resin film, an elastomer sheet, or the like. In order to weld the thin plate-like members 50 to the flow path defining member 40, the flow path defining member 40 and the thin plate-like members 50 can be formed from the same type of resins or elastomers.

In order to form the channel-shaped flow path shown in FIG. 2, the flow path defining member 40 includes first, second, and third plate-like members 41, 42, and 43 that are connected to each other. At both edges of the second plate-like member 42, the first and third plate-like members 41 and 43 are connected to the second plate-like member so as to intersect the second plate-like member, for example, so as to be perpendicular to the second plate-like member.

The second flow path 32 is defined by a recess portion 42A formed in the second plate-like member 42 and the thin plate-like member 50 that seals the opening of the recess portion 42A. Note that, as shown in FIGS. 5 and 6, an example is shown in which, for example, four second flow paths 31 are formed in the flow path defining member 40, but the number can be set as appropriate depending on a type of the ink to be supplied and it is sufficient if at least one is formed.

The first flow path 31 is formed as a through hole 41A that extends through the first plate-like member 41 to communicate with the recess portion 42A of the second plate-like member 42. Similarly, the third flow path 33 is formed as a through hole 43A that extends through the third plate-like member 43 to communicate with the recess portion 42A of the second plate-like member 42.

The through holes 41A and 43A have rectangular cross sections in FIG. 5, which are the same in shape as that of the second flow path 32, but may have circular cross sections in view of processability. If so, the first and third flow paths 31 and 33 formed as the through holes 41A and 43A are not flat flow paths unlike the second flow path 32. However, as shown in FIG. 2, the first and third flow paths 31 and 33 are not located in the gap between the lower casing cover 11 and the upper casing cover 12, and hence are not necessarily needed to be made to be flat flow paths.

The ink supply flow path device 30A shown in FIGS. 4 to 6 can have an upstream plate-like member 44 on the upstream side of the first plate-like member 41, and can further have a downstream plate-like member 45 on the downstream side of the second plate-like member 43. The upstream plate-like member 44 has a recess portion 44A that communicates with the through hole 41A, and the downstream plate-like member 45 has a recess portion 45A that communicates with the through hole 43. Similarly to the recess portion 42A, these recess portions 44A and 45A are also sealed by the thin plate-like members 50 to form an upstream flow path 34 and a downstream flow path 35. However, the upstream plate-like member 44 and the downstream plate-like member 45 are not essential, and ink supply tubes connected to the first and third plate-like members 41 and 43 may be substituted therefor. This is because the upstream plate-like member 44 and the downstream plate-like member 45 are not located in the gap between the lower casing cover 11 and the upper casing cover 12, so that there is no possibility that the upstream plate-like member 44 and the downstream plate-like member 45 will be pinched between the lower casing cover 11 and the upper casing cover 12. Thus, in the case of using the substitutive tubes, the cross-sectional area of the flow path may be larger than that of the flat flow path of the ink supply flow path device 30A. This is intended to reduce the flow path resistance for securing smooth ink supply. The above can similarly apply to later-described second to fourth embodiments.

The ink supply flow path device 30A according to the first embodiment is located in the gap between the lower casing cover 11 and the upper casing cover 12 as in FIG. 2. Moreover, the ink supply flow path device 30A is held by the upper edge of the lower casing cover 11 being inserted into the recess portion of the channel-shaped ink supply flow path device 30A.

In the ink supply flow path device 30A, particularly, the second flow path 32 located in the gap between the lower casing cover 11 and the upper casing cover 12 is a flat flow path defined by the thin plate-like member 50 and has shape retention. Thus, even when the upper casing cover 12 is opened or closed as in FIG. 1(C), the ink supply flow path device 30A can stably supply the ink without the bent flat flow path being pinched between the lower casing cover 11 and the upper casing cover 12. Therefore, blank ejection at the recording head is prevented and breakdowns of the printer body 10 can be reduced. In addition, bubble trapping can be achieved at the second flow path 32.

(Second Embodiment of Ink Supply Flow Path Device)

Figure 7:
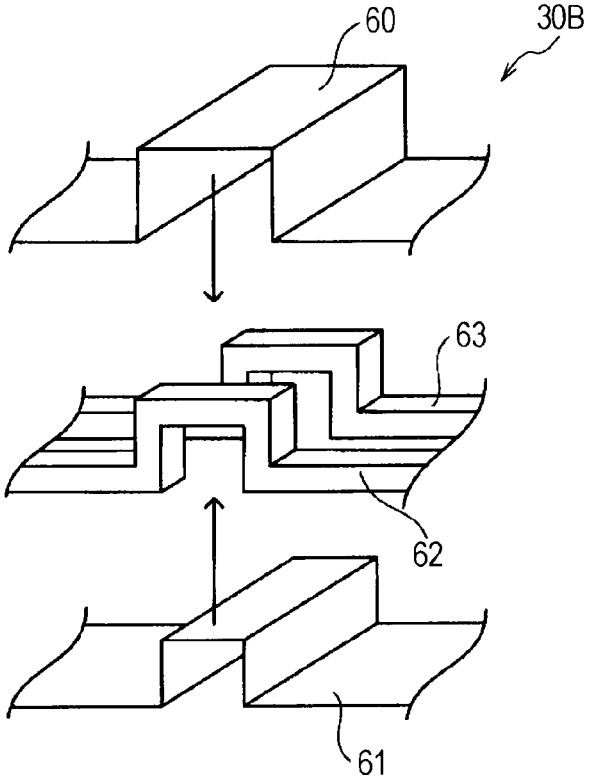
FIG. 7 is an exploded perspective view of a liquid supply flow path device according to a second embodiment.
Figure 8:
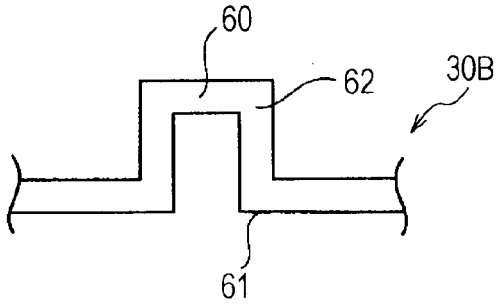
FIG. 8 is a schematic explanatory view showing a state where the liquid supply flow path device according to the second embodiment is bent in the mounting form of FIG. 2.

FIGS. 7 and 8 shows an ink supply flow path device 30B according to a second embodiment of the invention. The ink supply flow path device 30B includes, as a flow path formation member, for example, first and second thin plate-like members 60 and 61 that are formed so as to be bent along the first, second, and third flow paths 31, 32, and 3 shown in FIG. 2 and are located so as to be spaced apart from and face each other for securing each flow path height of the first, second, and third flow paths 31, 32, and 33; and at least two partition members 62 and 63 that are formed so as to be bent along the first, second, and third flow paths 31, 32, and 33, are located between the facing first and second thin plate-like members 60 and 61, and are located so as to be spaced apart from and face each other for securing each flow path height of the first, second, and third flow paths 31, 32, and 33. Note that, in order to form N (N is an integer equal to or more than 2) flow paths, it is only necessary to provide (N+1) partition members.

Here, various combinations of materials are considered for the first and second thin plate-like members 60 and 61 and the partition members 62 and 63. The combinations of materials are divided roughly into two types. A first type has shape retention to maintain the bent shapes of the first and second thin plate-like members 60 and 61, and a second type does not have the shape retention.

In the case of the first type, the first and second thin plate-like members 60 and 61 secure shape retention by being formed from a metal or a hard resin. For the materials of the partition members 62 and 63 in the first type, it is acceptable if they are materials that can provide a partitioning function when being sandwiched between the first and second thin plate-like members 60 and 61, and examples thereof can include resins, metals, elastomers, rubbers, and the like.

In the case of the second type, the materials of the first and second thin plate-like members 60 and 61 can include materials that do not have shape retention themselves and have flexibility, e.g., resin films, elastomer sheets, rubber sheets, and the like. In this case, the first and second thin plate-like members 60 and 61 are located so as to be deformed and bent along the surfaces of the partition members 62 and 63 having shape retention. As the materials of the partition members 62 and 63 in the second type, for example, resins, metals, elastomers, rubbers, and the like can be also used.

The ink supply flow path device 30B according to the second embodiment is also located in the gap between the lower casing cover 11 and the upper casing cover 12 as in FIG. 2. Moreover, the ink supply flow path device 30 is held by the upper edge of the lower casing cover 11 being inserted into the recess portion of the channel-shaped ink supply flow path device 30B.

In the ink supply flow path device 30B, particularly, the second flow path 32 located in the gap between the lower casing cover 11 and the upper casing cover 12 is a flat flow path defined by the first and second thin plate-like members 60 and 61, and the first and second thin plate-like members 60 and 61 and/or the partition members 62 and 63 have shape retention. Thus, even when the upper casing cover 12 is opened or closed as in FIG. 1(C), the ink supply flow path device 30B can stably supply the ink without the bent flat flow path being pinched between the lower casing cover 11 and the upper casing cover 12. Therefore, blank ejection at the recording head is prevented and breakdowns of the printer body 10 can be reduced. In addition, bubble trapping can be achieved at the second flow path 32.

Figure 9:
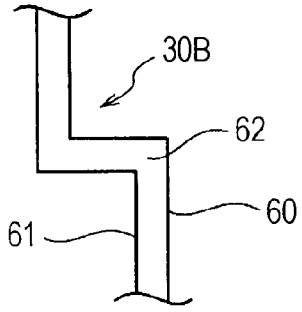
FIG. 9 is a schematic explanatory view showing a state where the liquid supply flow path device according to the second embodiment is bent in the mounting form of FIG. 3.

Further, unlike the first embodiment, the ink supply flow path device 30B according to the second embodiment does not have limitations on the bending direction. Thus, for example, when a crank-shaped flow path as shown in FIG. 3 is formed, the ink supply flow path device 30B can deal with this case by being bent as shown in FIG. 9.

(Third Embodiment of Ink Supply Flow Path Device)

Figure 10:
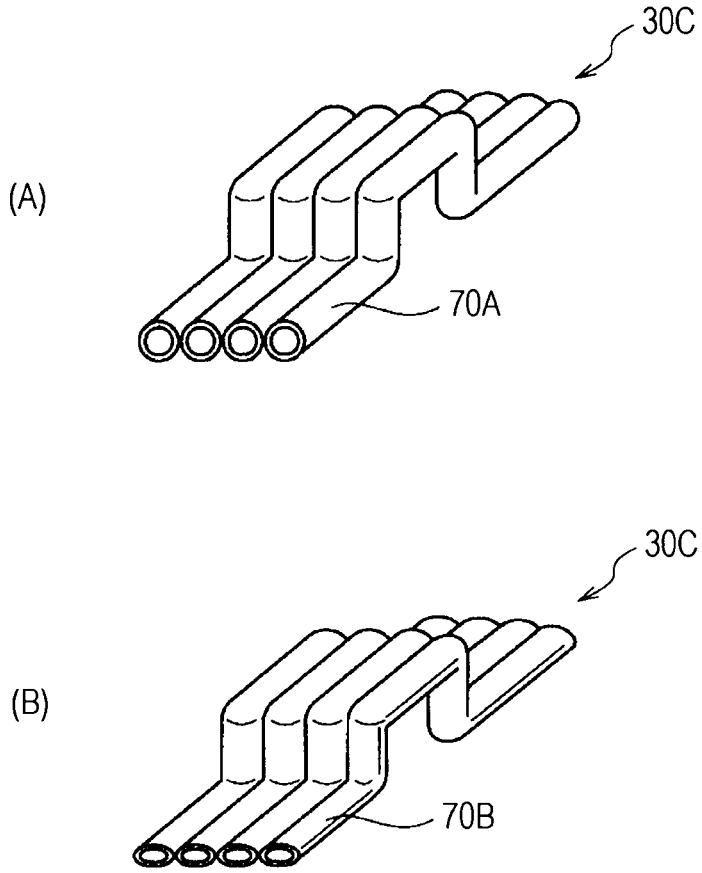
FIGS. 10(A) and 10(B) are schematic perspective views of a liquid supply flow path device according to a third embodiment.

FIGS. 10(A) and 10(B) show an ink supply flow path device 30C according to a third embodiment. The ink supply flow path device 30C is formed, as a flow path formation member, of a plurality of metal pipes 70A or 70B which are formed so as to be bent along the first, second, and third flow paths 31, 32, and 33 shown in FIG. 2 and define a plurality of flow paths, and the plurality of metal pipes are arranged in parallel. The metal pipes 70A shown in FIG. 10(A) have circular flow paths, but the metal pipes 70B shown in FIG. 10(B) may be used which have flat, elliptical flow paths in which flow path heights are smaller than flow path widths.

The ink supply flow path device 30C according to the third embodiment is also located in the gap between the lower casing cover 11 and the upper casing cover 12 as in FIG. 2. Moreover, the ink supply flow path device 30 is held by the upper edge of the lower casing cover 11 being inserted into the recess portion of the channel-shaped ink supply flow path device 30C.

In the ink supply flow path device 30C, particularly, in the case of FIG. 10(B), the second flow path 32 located in the gap between the lower casing cover 11 and the upper casing cover 12 is a flat flow path and has shape retention. Thus, even when the upper casing cover 12 is opened or closed as in FIG. 1(C), the ink supply flow path device 30C can stably supply the ink without the bent flat flow path being pinched between the lower casing cover 11 and the upper casing cover 12. Therefore, blank ejection at the recording head is prevented and breakdowns of the printer body 10 can be reduced. In addition, bubble trapping can be achieved at the second flow path 32.

Further, in the ink supply flow path device 30C according to the third embodiment as well, the metal pipes 70A or 70B can be optionally bent. Thus, for example, when a crank-shaped flow path as shown in FIG. 3 is formed, the ink supply flow path device 30C can deal with this case.

(Fourth Embodiment of Ink Supply Flow Path Device)

Figure 11:
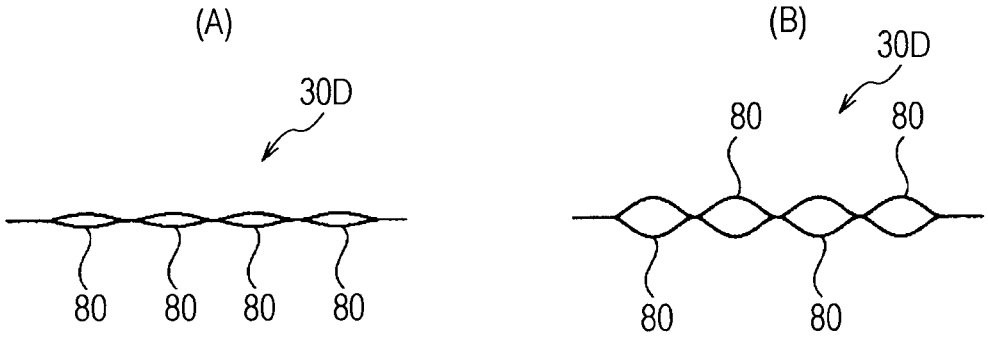
FIGS. 11(A) and 11(B) are schematic explanatory views of a liquid supply flow path device according to a fourth embodiment.

FIGS. 11(A) and 11(B) show an ink supply flow path device 30D according to a fourth embodiment. The ink supply flow path device 30D includes, as a flow path formation member, at least one, for example, four flexible tubes 80. The flexible tubes 80 are shrunk in a state before ink supply as shown in FIG. 11(A). However, the flexible tubes 80 are deformed so as to expand as shown in FIG. 11(B) when the ink is supplied by application of pressure or by suction passes therethrough, thereby securing necessary flow path cross-sectional areas.

The flexible tubes 80 can be formed by partially sticking two facing films, elastomer sheets, rubber sheets, or the like together by means of welding or adhesion.

Figure 12:
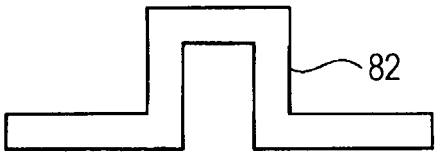
FIGS. 12(A) and 12(B) are schematic explanatory views of a holding case into which a flexible tube used in the fourth embodiment is inserted.
Figure 12:
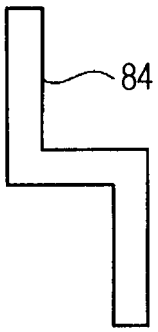

The ink supply flow path device 30D can be optionally deformed into a channel shape as shown in FIG. 2, a crank shape as shown in FIG. 3, or the like. However, the flexible tubes 80 do not have shape retention themselves. Thus, for example, the flexible tubes 80 are inserted into a channel-shaped holding case 82 or a crank-shaped holding case 84 shown in FIG. 12(A) or 12(B) to hold shape retention by these holding cases 82 and 84, and can be located between the lower and upper casing covers 11 and 12.

Further, in the ink supply flow path device 30D, for example, the second flow path 32 located in the gap between the lower casing cover 11 and the upper casing cover 12 shown in FIG. 2 is secured as a flat flow path as shown in FIG. 11(B). Thus, the ink supply flow path device 30D can stably supply the ink without being pinched between the lower casing cover 11 and the upper casing cover 12. Therefore, blank ejection at the recording head is prevented and breakdowns of the printer body 10 can be reduced. Even when being bent in a crank shape as shown in FIG. 3, the first to third flow paths 31 to 33 can be secured as flat flow paths. In addition, bubble trapping can be achieved at the second flow path 32.

(Mounting to Inside of Liquid Ejecting Apparatus)

Figure 13:
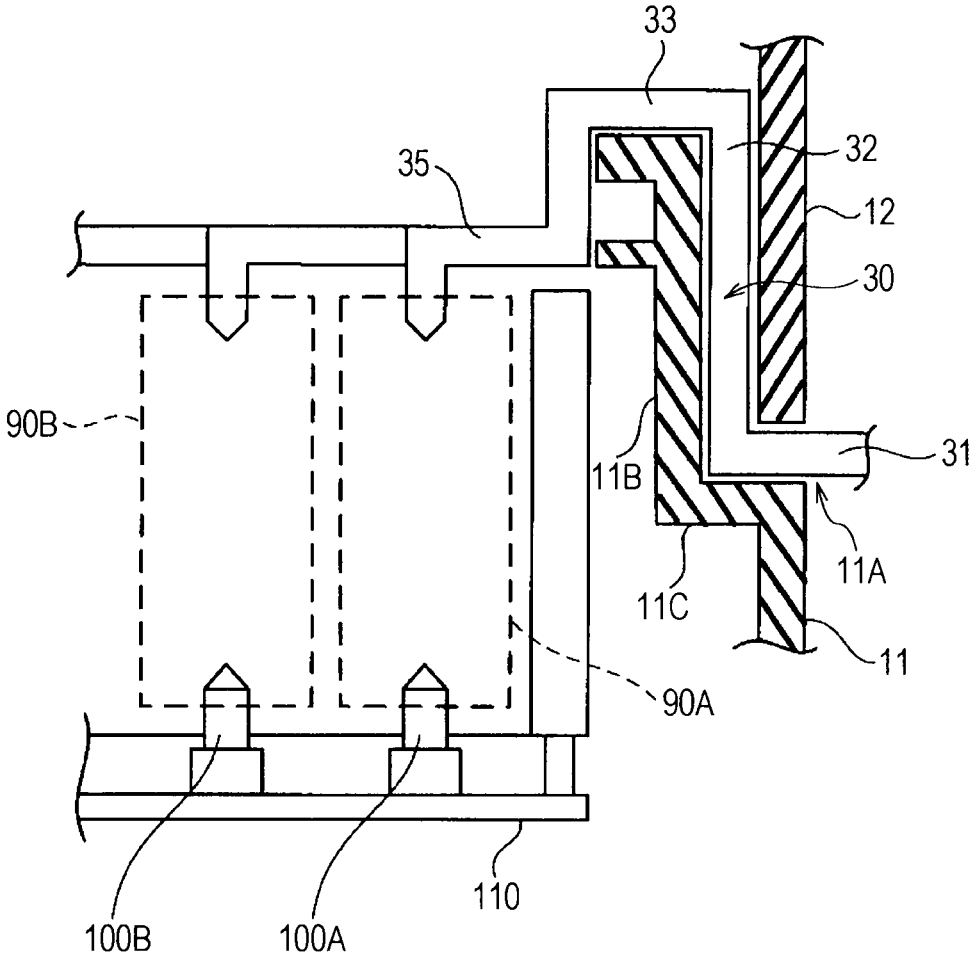
FIG. 13 is a schematic explanatory view showing one example of a mounting state of a liquid supply flow path device within a liquid ejecting apparatus body.

FIG. 13 shows the inside of the printer body 10 shown in FIG. 1. The printer body 10 has lower and upper casing covers 11 and 12 of the type of FIG. 3. The ink supply flow path device 30 is inserted into the inside of the printer body 10 through the cutout portion 11A of the lower casing cover 11, and the first to third flow paths 31 to 33 are formed so as to be bent in a crank shape along the gap between the lower and upper casing covers 11 and 12.

A flow path 35 on the downstream side of the third flow path 33 is connected to ink reservoirs 90A, 90B, . . . each of which is provided for each ink color. The mounting location of the ink reservoirs 90A and 90B is where an ink cartridge of off-carriage type is originally located. The ink cartridge does not have a structure in which an ink can be supplied from the outside thereto, and thus the ink reservoirs 90A and 90B are provided as a substitute therefor.

The ink reservoirs 90A and 90B are formed in a sac-like shape from a flexible film or the like, such as a resin film and/or an aluminum thin film, and have a damper ability. The ink reservoirs 90A and 90B can introduce the ink within the external tank 20 into the recording head by being connected to the recording head through: ink delivery members (liquid delivery members) 100A and 100B provided on the printer body 10 side; and an inner flow path 110 branched for each ink. Even in the printer body 10 of on-carriage type, the ink reservoirs 90A and 90B similarly may be provided. Alternatively, in both types, as a substitute for the ink reservoirs 90*a* and 90*b*, the ink supply flow path device 30 may be connected to an adapter that has a structure to be connected to an inner tube within the printer body 10.

Note that, although each embodiment has been described in detail, it should be readily understood by a person skilled in the art that many modifications that do not substantially depart from the new matter and the effects of the invention are possible. Therefore, all of such modified examples are included within the scope of the invention. For example, any term described at least once together with a broader or synonymous different term in the specification or the drawing, may be replaced by the different term at any places in the specification or the drawing.

Further, application of the liquid supply flow path device of the invention is not limited to the ink jet recoding apparatus. The liquid supply flow path device of the invention is applicable to various liquid ejecting apparatuses having: a liquid ejecting head that ejecting a very small amount of a droplet; and the like. Note that the droplet means a state of a liquid ejected from the liquid ejecting apparatus, and is intended to include a granule state, an a tear-like state, and a tailing filiform state.

Specific examples of the liquid ejecting apparatus include, for example, apparatuses having a color material ejecting head and used for manufacturing color filters for liquid crystal displays and the like; apparatuses having an electrode material (conductive paste) ejecting head and used for forming electrodes for organic EL displays, field emission displays (FEDs), and the like; apparatuses having a bioorganic substance ejecting head and used for manufacturing biochips; apparatuses having a sample ejecting head as a precise pipette; textile printing apparatuses; and microdispensers.

Further, in the invention, the liquid may be any material as long as it can be ejected by the liquid ejecting apparatus. A typical example of the liquid is the ink as described in the above embodiments. Here, the ink is intended to include various liquid compositions such as common water-based and oil-based inks, gel inks, and hot-melt inks. The liquid may be a material, such as liquid crystal, other than materials used for printing characters and images. In addition, in the invention, the liquid may be, in addition to a liquid as one state of a material, a liquid that is mixed with a solid material such as pigments and metal particles.

The invention claimed is:

1. A recording apparatus comprising:

a printer body having a case, and in the interior of the printer body is an ink nozzle;

an opening and closing member movably affixed to an upper side of the printer body, the opening and closing member being configured to open and close;

an external tank located completely exterior to the printer body; and a tube that provides a liquid from the external tank to the ink nozzle;

wherein a portion of the tube is exterior to the printer body;

wherein the tube extends into the printer body through a gap formed between an upper edge of the outer wall of the printer body and facing an edge of an outer wall of the opening and closing member in the closed position; and wherein an inner wall faces an inner side of the opening and closing member, and a step portion connects the inner wall with the upper edge of the printer body, and wherein the tube extends along the upper edge, the step portion, and the inner wall, and through the gap.

2. The recording apparatus according to claim 1, wherein the opening and closing member comprises a scanner.

3. The recording apparatus according to claim 1, wherein the external tank is located exterior to the opening and closing member.

4. The recording apparatus according to claim 1, wherein the gap is formed at a concave portion in the printer body or the opening and closing member.

5. The recording apparatus according to claim 4, wherein the concave portion includes a finger engage portion that engages the tube and through which the tube passes.

6. The recording apparatus according to claim 4, wherein the concave portion includes a cutout portion through which the tube passes.

7. The recording apparatus according to claim 6, wherein the cutout portion is formed in an upper edge of the outer wall of the printer body.

* * * * *